US006422769B1

(12) United States Patent
Twist et al.

(10) Patent No.: US 6,422,769 B1
(45) Date of Patent: Jul. 23, 2002

(54) SYSTEM AND METHOD FOR PROCESSING PHOTOGRAPHIC MATERIAL WHICH INCLUDES WASH WATER RECOVERY

(75) Inventors: Peter J. Twist, Bucks; Nigel R. Wildman, Herts, both of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/705,660

(22) Filed: Nov. 3, 2000

(51) Int. Cl.[7] ..... G03D 3/02
(52) U.S. Cl. ..... 396/626; 396/631
(58) Field of Search ..... 396/626, 620, 396/617–636; 210/251

(56) References Cited

U.S. PATENT DOCUMENTS

| | | | | |
|---|---|---|---|---|
| 4,457,495 A | | 7/1984 | Eder et al. | 210/688 |
| 4,857,950 A | * | 8/1989 | Takase et al. | 396/626 |
| 5,019,850 A | * | 5/1991 | Ishikawa et al. | 396/626 |
| 5,402,195 A | | 3/1995 | Glover et al. | 396/626 |
| 5,692,188 A | | 11/1997 | Watts et al. | 396/634 |

FOREIGN PATENT DOCUMENTS

| | | |
|---|---|---|
| DE | 3034102 | 5/1982 |
| EP | 430323 | 6/1991 |
| EP | 932078 | 7/1999 |

* cited by examiner

*Primary Examiner*—D Rutledge
(74) *Attorney, Agent, or Firm*—David A. Novais

(57) ABSTRACT

The present invention relates to a method and system for reusing a washing solution within a processor for processing photographic material. In the method and system of the present invention, sequential washing stages are applied to the processor. During one of the wash stages, and preferably a wash stage subsequent to an initial a first wash stage (a second wash stage), a volume of washing solution which is greater than the washing solution applied in the first wash stage is applied. The washing solution applied in the second or subsequent wash stage is subject to a chemical treatment such as an ion exchange, and is thereafter, recycled back to the processor for reuse in processing photographic material and/or cleaning the components of the processor.

8 Claims, 1 Drawing Sheet

SYSTEM AND METHOD FOR PROCESSING PHOTOGRAPHIC MATERIAL WHICH INCLUDES WASH WATER RECOVERY

FIELD OF THE INVENTION

The present invention relates generally to processing methods for silver halide photographic elements, particularly to the reuse of sources of water, particularly wash water, within the processing machine for photographic processing purposes.

BACKGROUND OF THE INVENTION

It is desirable, especially with small scale dispersed photofinishing equipment or stand-alone equipment, to reduce the number and complexity of operator interventions required to process photographic films. One way to achieve this is to package the processing solutions as concentrates, which are then mixed with water by the operator or mixed automatically by the processing machine to provide the working strength solution concentrations. The KODAK SM system automatically meters these concentrates into the processing machine and adds water, so that no chemical mixing is required by the operator. It is still necessary to provide the machine with water periodically, but these processors essentially are self-contained in that they contain all of the processing solution volumes they require on-board. In highly dispersed photofinishing it is not desirable to have to mix chemicals by hand frequently or to have to provide the machine with water frequently. It is also desirable to minimize waste generated from the processor.

Less expensive and more economical photographic processing equipment can be built if the automatic mixing and dilution of processing chemistry concentrates can be avoided. With these processing machines, processing chemicals are supplied at the working strength required by the processor, eliminating the need to dilute by hand and the need for accurate pumps for automatic mixing and dilution to working strength. This saves cost in manufacturing the processing machine, which also can be self-contained. It is still desirable to minimize the number of interventions required by the operator to replace empty packages of processing chemistry (in liquid or solid form) or to refill the processor with water used for processing. It is also desirable to minimize the volume of processing solutions required to be periodically replaced by the operator, and to minimize the volume of waste generated by the processor.

In single-use photographic processing small volumes of processing solution are used which are similar in size to the volumes used to replenish conventional large tank processors. These small volumes are used to process photographic materials such as negative films without the need for large volume tanks of processing solutions. After the process is complete these small volumes of solution are discarded. Thus the overflow or waste solution volume is similar to that from conventional processors with large volume tanks. In the wash stage of a single-use photographic process it is possible that several wash volumes will need to be added to the processor chamber or container to wash the film and also to wash the processor chamber or container at the end of the process. The first wash is added and after an appropriate time it is removed by some means and the second wash is added. This sequence is repeated for the desired number of washes. If the single-use processor is operated in an environment which does not have a water supply (meaning that the processor is not attached to a permanent water supply) then the total volume of water for washing a given amount of photographic material needs to be provided on-board the processor (it needs to be self-contained). One way to accomplish this is for the chemical supply, which includes the wash water, to be contained in a cartridge which is "plugged" into the machine. When it becomes empty after processing a certain amount of photographic material, the cartridge is removed and replaced by a fresh full cartridge. The size and weight of this cartridge must be limited to that which can be easily lifted and handled by an operator. It is desired therefore that the volumes of processing solutions and wash water be minimized, but it is also desired that the washing of the photographic materials be efficient and thorough, and that as large an amount as possible of photographic material be processed with the minimum volume of processing solutions. At the same time, it is desired to minimize the waste generated by the processor while achieving rapid processing.

EP 932078 (Masson) describes a process and a device for the treatment of photographic film. The film circulates in a series of processing baths in which washing occurs. The waste water from the washing areas is recovered for reuse by a nanofiltration device. There is no teaching in this document regarding the impact of such recycling when applied to processing machines that are self-contained machines which must carry on-board all of the processing solution chemistry and water necessary to process photographic materials. There is also no suggestion in this document that advantages with respect to processing solution consumption, waste generation, or rapid processing would result from recycling a relatively small volume of wash water.

EP 430323 (De Niel et al) describes a device for recovering silver from rinsing water from a photographic processor. The device includes a bed of ion exchange resin which is fluidized by the rinsing water and a holder for ion exchange resin with an inlet for liquid at the bottom.

DE 3034102 (Eder et al) describes the use of strongly basic anion exchange resins to remove silver from photographic wash waters.

These ion exchange methods use strongly basic or weakly basic anion exchange resins to remove the silver-bearing anions from the wash waters in order to recover silver. There is no teaching regarding the recycling of these wash waters and any benefits that might result from doing so. There is also no teaching regarding processing machines that are self-contained machines which must carry on-board all of the processing solution chemistry and water necessary to process photographic materials. There is further no suggestion in these references that advantages with respect to processing solution consumption, waste generation, or rapid processing would result from recycling a relatively small volume of wash water.

The present invention solves the problem of minimizing the volume and weight of wash water required to be provided on-board a self-contained photographic processor to process a finite amount of photographic material. This invention minimizes the waste generated by such a processor, and it permits more rapid processing of photographic materials to be achieved.

SUMMARY OF THE INVENTION

An object of the present invention is to provide for a system and method for conserving water on-board a processor, such as a self-contained photographic processor, as well as recovering and reusing the water after it has been used to process photographic material. The total volume of chemistry and water required to process a finite amount of silver halide photographic material (and the volume of waste generated from processing that material) is minimized significantly if a recycled volume of wash water (that has been treated to remove thiosulfate) is used to wash the material in a wash stage of a multi-stage wash sequence that is subsequent to a first wash stage. The wash sequence follows a treatment step with a processing solution with a fixing ability. In addition, the overall photographic process is significantly more rapid and the processing waste volume generated is also minimized. The small volume of water from the first wash stage is discarded to waste. Optional additional wash stages or a rinse may follow the wash stage that makes use of the recycled wash water volume.

The present invention therefore relates to a method for processing photographic material which comprises: providing a photographic material to a processor; supplying a processing solution to the processor to process the photographic material; applying a first volume of washing solution to the processed photographic material during at least one first washing stage; applying a second volume of washing solution to the processed photographic material during at least one second washing stage, with the second volume of washing solution applied during the at least one second washing stage being greater than the first volume of washing solution applied during the first washing stage; and cleaning the second volume of washing solution after the at least one second washing stage.

The present invention further relates to a processing arrangement which comprises: a processor adapted to process photographic material; a solution supply system adapted to supply washing solution to at least processed photographic material in the processor in a sequence in which at least a first volume of washing solution is applied during at least one first washing stage and a second volume of washing solution is applied during at least one second washing stage, with the second volume of washing solution being greater than the first volume of washing solution; and a cleaning assembly adapted to clean the second volume of washing solution after the at least one second washing stage.

DETAILED DESCRIPTION OF THE INVENTION

Figure 1:
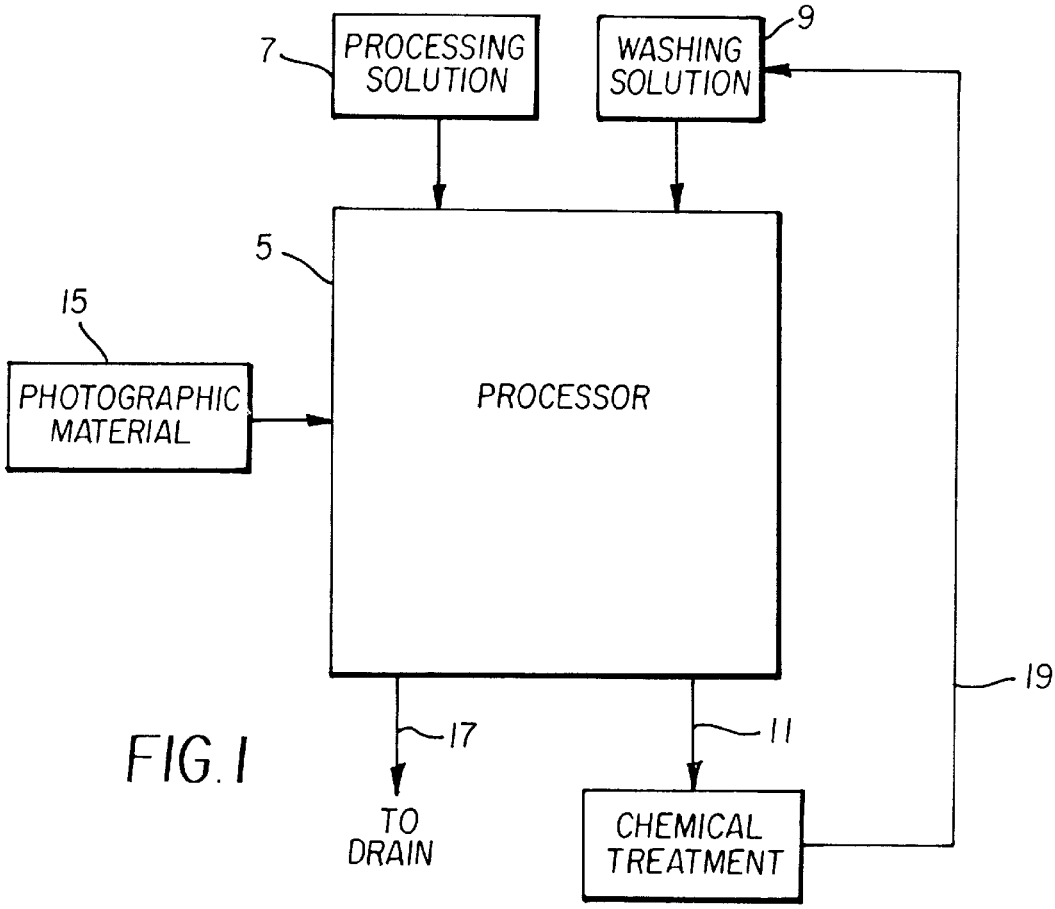
FIG. 1 schematically illustrates a processing arrangement in accordance with the present invention.

In single-use photographic processing it is desired to process photographic material, such as negative film, with very small volumes of processing solutions which can be discarded. In order to do this efficiently in washing steps and to achieve thoroughly washed film, a multitude of wash stages each of small volume may be used. This method of washing is called "SSV" for "Small Sequential Volumes". This method is complicated and time consuming. The present invention uses a larger volume of wash water to quickly and efficiently wash the film. The total volume is much larger than that used for the SSV method and is too large to be disposed of. In the practice of the invention, this larger volume of wash water is treated to remove chemical contaminants by some suitable means and recovered to re-use it to process more photographic material. This allows the overall volume of water in the processor to be kept low while allowing rapid and effective washing. The waste volume from the processor is also significantly reduced. This method is described as "FMR" for "Flooded Mode Recovered".

Single-use processing can be very efficient for processing stages up to the wash stage. In order to wash effectively more than one wash stage is required. Thus wash water is added and then removed in a sequential manner in several steps so that after the last step the residual salts in the film and in the processing chamber are thoroughly removed. It is estimated that a volume of 3.28 ml/linear meter of 35 mm film is left in the film and processing chamber. If the total volume available for the wash stage is 52.5 ml/linear meter and this wash stage is carried out in one addition of 52.5 ml/linear meter, then a dilution factor of 1+16=17 is obtained. If smaller volumes of 13.1 ml/linear meter each are added to the chamber and film and then removed then the dilution factor is 1+4=5 for each addition/removal step. If 4 steps are used this generates a total dilution factor of 5×5×5×5=625 for a total volume of 52.5 ml/linear meter of 35 mm film in this SSV method of washing.

Regarding the archival levels of retained chemicals, to achieve satisfactory long-term (decades) image stability of processed color negative films, it is desirable that the residual amounts of two chemicals in the film be below certain levels:

| | |
|---|---|
| ammonium thiosulfate | less than or equal to 0.95 g/l |
| color developing agent CD4 | less than or equal to 0.015 g/l |

This is based on washing experiments and from accelerated keeping experiments of film samples at elevated humidity and temperature.

A dilution factor of 625 is more than adequate to achieve these residual amounts using single-use processing solutions. Thus for 100 rolls of 24 exposure 35 mm color negative films (about 1.07 meter long) the total wash volume needed is 100 rolls×52.5 ml/meter×1.07 meter/roll=5600 ml for the SSV wash process.

The present invention can be applied to any photographic process or processor in which the volumes of processing chemistry and water required to process photographic materials are self-contained or on-board the processor.

FIG. 1 schematically illustrates a processing arrangement having a processor 5. Such processors are sometimes referred to as "plumbless" or "plumbing less" processors . Such a processor 5 can be typically small and compact minilabs or microlabs into which is introduced photographic material 15. These processors may be similar to the Kodak SM processors or LVTT processors. The processing solutions may be present in a sequence of processing tanks which are supplied by replenisher solutions, replenisher tablets, or solution concentrates. Alternatively, the processing solutions may be delivered as working strength solutions in a sequence of processing tanks or reactors, or in a single reactor, which are not replenished. The processing solutions may be applied in small volumes at working strength concentration to the photographic materials in single-use applications in batch processors such as those described in GB 0023091.2, a drum-type of processor as described in U.S. Pat. No. 5,692,188, a drum-type of processor such as the R-11 drum processor manufactured by Eastman Kodak Company, or a belt-type of processor as described in U.S. Pat. No. 5,402,195.

The photographic process can be any process that employs a multi-stage wash sequence to remove processing chemicals from the photographic material prior to drying. A washing solution supply system 9 is used to supply washing solution to processor 5. One requirement of the invention is that a wash sequence comprise at least two wash stages following a treatment step with a solution with a fixing ability. In the system of the present invention, a volume of washing solution which is applied in a second washing stage subsequent to a first washing stage is treated at a chemical treatment or cleaning assembly 11 and recycled via a line 19 to washing solution supply system 9. A recycled volume of wash water (that has been treated at treatment or cleaning assembly 11 to remove thiosulfate) is used to wash the photographic material in a wash stage of the multi-stage wash sequence that is subsequent to the first wash stage. Additional wash stages or a rinse may follow the wash stage that makes use of the recycled wash water volume.

Therefore, as illustrated in FIG. 1, photographic material 15 which is introduced to processor 5, can be treated with processing solution applied via a processing solution supply system 7. After processing, waste processing solution can be drained via drain 17. Thereafter, washing solution can be applied via washing solution supply system 9 to the photographic material 15 and/or the components of the processor 5. During this at least one first washing stage, due to the amount of contaminants in the washing solution, this initial volume of washing solution is drained via drain 17. It is noted that a predetermined volume of washing solution is applied during the at least one first washing stage. Thereafter, at least one subsequent and/or second washing stage can be applied to the photographic material and/or the components of processor 5 via washing solution supply 9. In the at least one second or subsequent washing stage, a second volume of washing solution which is greater than the first volume of washing solution is supplied to processor 5. This second volume of washing solution is not drained at drain 17 but instead is applied to a chemical treatment or cleaning assembly 11 which treats/cleans the waste washing solution and recycles the cleaned washing solution via line 19 back to washing solution supply system 9 for reuse in processor 5. It is noted that the recycled washing solution can be further circulated to other elements of a processing arrangement such as a separate washing section. Also, although separate processing and washing solution supply systems are shown, the present invention is not limited thereto. It is recognized that a single or multiple metering and/or supply systems can be utilized. Additionally, in the system of the present invention, the control of the volume of wash water applied during the noted wash stages, as well as the control of the operation of the processing and/or washing solution supply systems can be automated and controlled by, for example, a preprogrammed computer, or can be manually controlled by an operator.

The treatment method used at treatment assembly 11 to recycle the wash water may be any method that effectively removes thiosulfate ion from water to a level below 5 g/L, more preferably below 1 g/L, and most preferably below 0.1 g/L. Such methods include anion exchange methods useful for the treatment of photographic wash waters. Such methods are described in D. A. Branch, *Journal of Imaging Technology,* Vol. 14, No. 6, pages 160–166 (1988) and references therein. Use of a mixed-bed $H^+$ and $OH^-$ ion exchange resin is particularly effective in that it removes cations as well as anions from the wash water. Nanofiltration methods or reverse osmosis methods may be used.

The volume of wash water used to wash the photographic material in the wash stage that uses recycled water in the process should be equal to or greater than 1.03 L/sq. meter of photographic material (36 mL/meter of 35 mm film). This volume is treated to remove thiosulfate after processing, and then reused again in the same washing stage.

The dilution factor of the multi-stage washing sequence (which may include a rinse after the last washing stage) should be greater than or equal to X/0.95 where X is the thiosulfate concentration of the processing solution with a fixing ability used prior to the washing sequence (expressed as X g/L of ammonium thiosulfate).

EXAMPLE 1

This is a comparative or comparison example.

In this example the photographic process is carried out in a rotary single-use film processor which uses very small volumes that are equivalent to the replenishment volumes used on large processors with large volume tanks of solution for each processing step. No other volume apart from these small volumes is required for the single-use processor to properly process film. Thus the chemical usage of the single-use processor is the same or better than a large volume tank processor but has no large volume solutions in tanks to maintain. At the end of each stage these small volumes are removed from the processor and discarded. The wash is carried out by means of four sequential wash steps. The process cycle A is shown in Table(1).

TABLE 1

| Process Cycle (A) 60 deg C. | | |
|---|---|---|
| Develop | 30 seconds | 19.7 ml/linear meter 35mm film |
| Stop solution removal | 10 seconds | 13.1 ml/linear meter |
| Bleach solution removal | 30 seconds | 19.7 ml/linear meter |
| Fix solution removal | 50 seconds | 197 ml/linear meter |
| wash (1) solution removal | 15 seconds | 13.1 ml/linear meter |
| wash (2) solution removal | 15 seconds | 13.1 ml/linear meter |
| wash (3) solution removal | 15 seconds | 13.1 ml/linear meter |
| rinse (4) | 15 seconds | 13.1 ml/linear meter |
| Total (wash + rinse) | 60 seconds | 52.5 ml/linear meter |

The composition of the Developer is shown in Table(2), the Bleach in Table(3) and the Fixer in Table(4).

TABLE 2

| Developer Composition | |
|---|---|
| $Na_2SO_3$(anhydrous) | 10.53 g/l |
| Hydroxylamine sulfate | 3.0 g/l |
| Diethylenetriamine-pentaacetic acid | 2.6 g/l |
| KI | 0.002 g/l |
| Polyvinylpyrrolidone(K15) | 3 g/l |
| NaBr | 2.8 g/l |
| $K_2CO_3$ | 40 g/l |
| Kodak Developing Agent CD4 | 15 g/l |
| pH | 10.48 |
| Photo-Flo* | 1 ml/l |

TABLE 3

| Bleach Composition | |
|---|---|
| grams 1,3-Propanediaminetetraacetic acid (MW 306.24) | 156.8 |
| grams Succinic Acid (MW 118.09) | 105.0 |

TABLE 3-continued

| Bleach Composition | |
|---|---|
| grams NH4Br (FW 98) | 60.0 |
| grams Fe(NO3)3*9H2O (FW 404) | 188.1 |
| NH4OH | 200 mL |
| Bring to a Volume of: | 950 mL |
| with Water | |
| pH Adjust to: | 4.75 |
| with HNO3 or NH4OH | |
| Bring to Final Volume of: | 1.0 liters |

TABLE 4

| Fixer Composition | |
|---|---|
| Ammonium sulfite | 21.5 g/l |
| ammonium thiosulfate | 264 g/l |
| EDTA.$Na_2 2H_2O$ | 1.08 g/l |
| 1,2,4-Triazole-3-thiol | 1.0 g/l |
| pH | 7.9 |
| Photo-Flo* | 1 ml/l |

*Kodak Professional Photo-Flo ™ 200 Solution manufactured by Eastman Kodak Company.

The rinse solution is a solution of Kodak Flexicolor™ final rinse and replenisher in water, 9 ml/l.

The fixer composition in Table (4) contains 264 g/l of ammonium thiosulfate. The fixer is the last processing solution to be removed before the wash stage and so 3.28 ml/linear meter of 264 g/l ammonium thiosulfate remains. This needs to be diluted by at least 264/0.95=278 times. The dilution factor for a number of sequential washes in SSV processing is shown in Tables(5), (6), and (7). Here the dilution factor for each wash step is (3.28+x)/3.28 where x is the volume per wash step in ml/linear meter.

TABLE 5

Sequential washes (19.7 ml/linear meter)

| No. of washes | wash volume | dilution factor |
|---|---|---|
| 1 | 19.7 ml/linear meter | 7 |
| 2 | 19.7 ml/linear meter | 49 |
| 3 | 19.7 ml/linear meter | 343 |
| Total | 59.1 ml/linear meter | |

Thus three washes of 19.7ml/linear meter each will give the required dilution factor.

TABLE 6

Sequential washes (13.1 ml/linear meter)

| No. of washes | wash volume | dilution factor |
|---|---|---|
| 1 | 13.1 ml/linear meter | 5 |
| 2 | 13.1 ml/linear meter | 25 |
| 3 | 13.1 ml/linear meter | 125 |
| 4 | 13.1 ml/linear meter | 625 |
| Total | 52.4 ml/linear meter | |

Thus four sequential wash stages are required if the volume per stage is 13.1 ml/linear meter. A larger number of smaller volume wash stages is more efficient in terms of the total volume used for example with 6.6 ml/linear meter as shown in Table(6). Here six steps are required to reach the dilution factor of at least 278 times.

TABLE 7

Sequential Washes (6.6 ml/linear meter)

| No. of washes | wash volume | dilution factor |
|---|---|---|
| 1 | 6.6 ml/linear meter | 3 |
| 2 | 6.6 ml/linear meter | 9 |
| 3 | 6.6 ml/linear meter | 27 |
| 4 | 6.6 ml/linear meter | 81 |
| 5 | 6.6 ml/linear meter | 243 |
| 6 | 6.6 ml/linear meter | 729 |
| Total | 39.6 ml/linear meter | |

Although a larger number of small washes is more efficient in terms of total wash water volume used more stages are required and since the wash is removed after each step this becomes complicated and time consuming. Thus 13.1 ml/linear meter is economical on volume and time.

The dilution factor required for thorough washing depends on the thiosulfate concentration of the solution with a fixing ability used prior to the washing stages. This dilution factor is X/0.95 where X is the concentration of the thiosulfate in the solution with a fixing ability (expressed as X g/L of ammonium thiosulfate, although other thiosulfate salts may be used in the solution with a fixing ability).

EXAMPLE 2

This is an example of the present invention.

In this example part of the water used in the wash stage is recovered by means of ion exchange. The amount of ammonium thiosulfate in 3.28 ml/linear meter of fixer retained in the film and processing chamber is 264×1/1000×3.28=0.866 g/linear meter. It is possible to remove all this by ion exchange but a larger amount of ion exchange resin would be needed. If the first wash stage used and the water from this stage is disposed of, then a more economical use of ion exchange resin is possible. The process cycle shown in Table(8) was used. The developer, bleach, and fixer were as described above in Example 1.

TABLE 8

| Process Cycle (B) | | |
|---|---|---|
| Develop | 30 seconds | 19.7 ml/linear meter 35mm |
| Stop solution removal | 10 seconds | 13.1 ml/linear meter |
| Bleach solution removal | 30 seconds | 19.7 ml/linear meter |
| fix solution removal | 50 seconds | 19.7 ml/linear meter |
| wash (1) solution removal | 15 seconds | 13.1 ml/linear meter |
| wash (2) solution removal | 10 seconds | 59.1 ml/linear meter ion-exchange recovered |
| rinse (3) | 5 seconds | 13.1 ml/linear meter |
| Total (wash + rinse) | 30 seconds | 26.2 ml/linear meter |

The dilution factor here is 5×19×5=475 which is achieved in three steps. In practice the volume used for step 2 can be larger than this as described next. The volume used here for the wash step(2), 59 ml/linear meter, is close to the minimum required (36.1 mL/linear meter for a dilution factor of 5×12×5=300).

It is easy and more effective to use a larger volume since all the wash water used is recovered and exactly the same amount of resin is used whatever the wash volume since the amount of thiosulfate to be removed is the same. In a version of process cycle(B) used in the test, 150 ml of wash water(2) was flooded into the processing chamber and onto the film. This rapidly dilutes residual thiosulfate by more than the required dilution factor. The dilution factor at this stage is 5×150=750 which is well beyond the desired limit. In addition this means that the final rinse is not needed to act as a diluting step, it may be performed much faster than in 15 seconds, and it mainly acts to provide a wetting agent to the film surface to remove water marks during drying. This is the FMR process, or "Flooded Mode Recovered."

The water from the first and last steps are the only ones which are discarded through drain 17 (FIG. 1) and this gives a total of 26.2 ml/linear meter which is equivalent to 2800 ml for 100×24 exposure 135 films. The volume which supplies the 59 ml/linear meter is the part which is recycled through chemical treatment or cleaning assembly 11 (FIG. 1) and in this example it was done by means of an ion exchange column. The amount of thiosulfate in 3.28 ml/linear meter of fixer residue is 0.866 g as shown above. If the first wash of 13.1 ml/linear meter is discarded then the residue is lowered to 0.866/5=0.173 g/linear meter. The total amount of ammonium thiosulfate residue that needs to be removed from wash(2) used to process 100 rolls of 24 exposure 35 mm film is 0.173×100×1.07 m/roll=18.48 g.

The ion exchange resin used was MB 5113 from BDH/Merck. This is a mixed bed resin in $H^+$ and $OH^-$ forms. Unlike the anion exchange resins commonly used to remove silver from photographic wash waters, this removes all anions and cations other than $H^+$ and $OH^-$ from the wash water. The fixer solution(Table(4)) was diluted 30 times to give an ammonium thiosulfate concentration of 8.8 g/l. 150 ml of this solution was stirred with 25 g of resin and samples taken every 10 seconds and analyzed for ammonium thiosulfate. The result is shown in the graph of FIG. 2 which illustrates the rate of removal of annonium thiosulfate on MB 5113.

Figure 2:
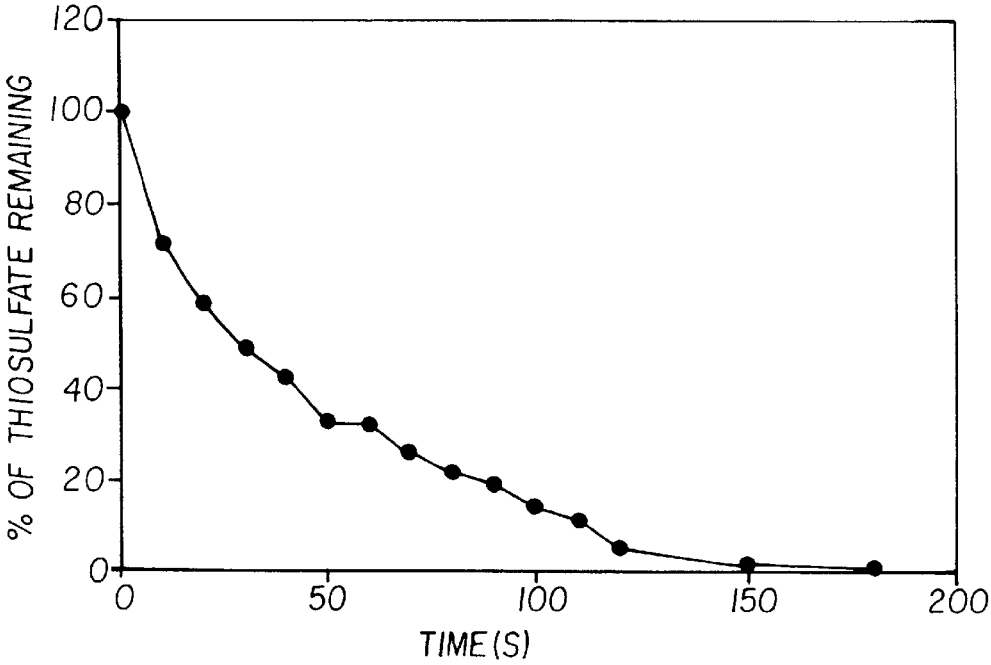
FIG. 2 shows a graph which illustrates a rate of removal of thiosulfate.

As shown in the graph of FIG. 2, all the thiosulfate is removed in about 2.5 minutes. One gram of resin absorbed 0.07 g of ammonium thiosulfate. Thus the total amount of resin required for 100 rolls of 24 exposure 35 mm film is 18.48/0.07=264 g.

A process cycle(C) was carried out with the times and volumes as shown in Table(8) except that the second wash step used 150 ml and the total resident volume of the recycled wash water was 250 ml. In the second wash step the processing chamber and the film was flooded with 150 ml of wash water which after the process was recycled through a column containing 264 g of resin. This reduced the thiosulfate in the water to zero in 3 minutes.

Thus, in this example, the resident volume of wash to be re-used, 250 ml the total volume of the wash part of the chemical delivery cartridge is shown in Table(9)

TABLE 9

| Example (2) compared with Example (1) for 100 × 24 exposure 35mm films | | |
|---|---|---|
| | Invention | Comparison |
| Volume discarded (waste) | 2800 ml | 5600 ml |
| Volume for recycling | 250 ml | 0 |

TABLE 9-continued

| Example (2) compared with Example (1) for 100 × 24 exposure 35mm films | | |
|---|---|---|
| | Invention | Comparison |
| Volume of resin | 264 ml | 0 |
| Total volume | 3314 ml | 5600 ml |

Thus, in the example of the invention, the total amount of wash water to be included in the chemical delivery package is reduced by 2286 ml. The waste volume from the processor has similarly been considerably reduced. Thus the first part of the invention to lower the on-board volume in the chemical delivery cartridge and to lower the waste volume from the processor has been demonstrated.

In addition in Example 2 Process Cycle(B) the wash time is 30 seconds compared with 60 seconds for the comparative Process Cycle(A) in Example 1. This is because the second and third wash stages are combined which removes one wash step and that the wash is done with a large volume which quickly dilutes the residual thiosulfate so that the wash step can be shorter. Thus the recycled wash(2) stage is effective in 10 seconds. The final rinse is not required in the method of the invention to wash the film and remove contaminants; it merely adds a surfactant to the film to aid rinsing and drying. Thus the second part of the invention to shorten the wash time has been demonstrated.

Although the present invention discusses a first wash stage as well as a second wash stage, it is noted that the present invention is not limited to a single first wash stage and a single second wash stage. For example, the first wash stage can be comprised of a plurality of wash stages of a predetermined first volume. Since these wash stages would occur after a processing stage, the amount of contaminates in the waste washing solution is greater. The washing solution from the first washing stage or stages would be applied to drain as discussed above. The second wash stage or stages in accordance with the present invention can be of a volume greater than the volume of the first wash stage or stages. As described above, the washing solution from the second wash stage or stages can be treated at a chemical treatment assembly and recycled back to the processor. Further, the recycled washing solution can be applied for the photographic material and/or used to clean components the processor.

The invention has been described in detail with particular reference to certain preferred embodiments thereof, but it will be understood that variations and modifications can be effected within the spirit and scope of the invention.

What is claimed is:

1. A method for processing photographic material comprising:

providing a photographic material to a single-use processor;

supplying a processing solution to the processor to process the photographic material during multiple processing steps and removing the processing solution after each processing step;

applying a first volume of washing solution to the processed photographic material during at least one first washing stage and discarding said first volume of washing solution;

applying a second volume of washing solution to the processed photographic material during at least one second washing stage and removing said second volume of washing solution, the second volume of washing solution applied during the at least one second washing stage being greater than the first volume of washing solution applied during the at least one first washing stage; and cleaning the removed second volume of washing solution after the at least one second washing stage.

2. A method according to claim 1, further comprising:

recycling the cleaned second volume of washing solution for the next film to be processed.

3. A method according to claim 1, further comprising:

draining the first volume of washing solution before the second volume of washing solution is added.

4. A method according to claim 1, wherein said cleaning step comprises an ion exchange.

5. A processing arrangement comprising:

a processor adapted to process photographic material in a manner in which processing solution is supplied to be processor during multiple processing steps and removed after each processing step;

a solution supply system adapted to supply washing solution to at least processed photographic material in the processor in a sequence in which at least a first volume of washing solution is applied during at least one first washing stage and discarded, and a second volume of washing solution is applied during at least one second washing stage and removed, the second volume of washing solution being greater than the first volume of washing solution; and a cleaning assembly adapted to clean the removed second volume of washing solution after the at least one second washing stage.

6. A processing arrangement according to claim 5, further comprising:

a recycling arrangement adapted to recycle the cleaned second volume of washing solution back to the solution supply system.

7. A processing arrangement according to claim 5, wherein the processor comprises a drain for draining at least the first volume of washing solution after the at least one first washing stage.

8. A processing arrangement according to claim 5, wherein the cleaning assembly comprises an ion exchange column.

* * * * *